US010595584B2

(12) United States Patent
Silva

(10) Patent No.: US 10,595,584 B2
(45) Date of Patent: Mar. 24, 2020

(54) ADJUSTABLE ARTICLE SYSTEM

(71) Applicant: Christopher Anthony Silva, Little Egg Harbor, NJ (US)

(72) Inventor: Christopher Anthony Silva, Little Egg Harbor, NJ (US)

( * ) Notice: Subject to any disclaimer, the term of this patent is extended or adjusted under 35 U.S.C. 154(b) by 300 days.

(21) Appl. No.: 15/009,357

(22) Filed: Jan. 28, 2016

(65) Prior Publication Data

US 2017/0215516 A1 Aug. 3, 2017

(51) Int. Cl.

| | |
|---|---|
| ***A43B 3/26*** | (2006.01) |
| ***A43B 23/02*** | (2006.01) |
| ***A43B 7/14*** | (2006.01) |
| ***A43B 3/00*** | (2006.01) |
| ***A43C 11/00*** | (2006.01) |

(52) U.S. Cl.

CPC ..... *A43B 3/26* (2013.01); *A43B 3/0078* (2013.01); *A43B 7/14* (2013.01); *A43B 23/0215* (2013.01); *A43C 11/00* (2013.01)

(58) Field of Classification Search

CPC ..... A43B 3/26; A43B 3/0078; A43B 7/14; A43B 5/0427; A43B 5/1608; A43B 23/0215; A43B 23/0285; A43B 23/029; A43B 23/028; A43B 11/00; A43B 23/027; A43B 3/0005; A43B 1/0018; A43C 11/002; A43C 11/00; A43C 11/004; A43C 11/006; A43C 11/008; A43C 11/22

USPC ..... 36/97, 93, 50.1, 51, 83, 119.1, 118.1, 36/50.5; 383/3, 118; 206/522

See application file for complete search history.

(56) References Cited

U.S. PATENT DOCUMENTS

| | | | | |
|---|---|---|---|---|
| 5,343,638 | A * | 9/1994 | Legassie | A43B 3/0005 36/28 |
| 6,438,872 | B1 * | 8/2002 | Chil | A43B 1/0072 36/102 |
| 6,990,755 | B2 * | 1/2006 | Hatfield | A43B 3/0057 36/102 |
| 7,380,351 | B1 * | 6/2008 | Pavone | A43B 1/0072 36/28 |
| 8,661,714 | B2 * | 3/2014 | Sussmann | A43B 3/24 36/102 |
| 8,769,844 | B2 * | 7/2014 | Beers | A43B 3/0005 36/50.1 |
| 8,887,411 | B2 * | 11/2014 | Lacorazza | A43B 3/26 36/45 |
| 2010/0083535 | A1 * | 4/2010 | Meschter | A43B 7/1495 36/88 |
| 2011/0035963 | A1 * | 2/2011 | Baker | A43B 1/0018 36/114 |

(Continued)

*Primary Examiner* — Anna K Kinsaul
*Assistant Examiner* — F Griffin Hall
(74) *Attorney, Agent, or Firm* — Porzio Bromberg & Newman P.C.

(57) ABSTRACT

The present invention is directed to an adjustable footwear system to provide varying degrees of tightness in different areas of the footwear before and after the footwear is received on the foot. The footwear is, in its initial form, tightest on the inner cavity with an upper comprised of one or more elastic materials. An extensor system is activated to create a rigid infra-structure to open a cavity of the footwear between the upper and an insole. A decrease of pressure in the extensor system decreases the cavity volume and allows for the elastic upper to apply pressure to the foot.

5 Claims, 12 Drawing Sheets

(56) References Cited

U.S. PATENT DOCUMENTS

| | | | | |
|---|---|---|---|---|
| 2015/0013184 | A1* | 1/2015 | Beers | A43C 11/004 36/83 |
| 2016/0249706 | A1* | 9/2016 | Leary | A43B 7/1495 36/93 |
| 2016/0309834 | A1* | 10/2016 | Zwick | A43B 5/025 |
| 2016/0331082 | A1* | 11/2016 | Weidl | A43B 3/26 |
| 2016/0366978 | A1* | 12/2016 | Holt | A43B 1/04 |
| 2017/0000210 | A1* | 1/2017 | Bigolin | A43C 1/003 |

* cited by examiner

ADJUSTABLE ARTICLE SYSTEM

BACKGROUND OF THE INVENTION

Field of the Invention

The present invention relates in general to an adjusting system for an article and in particular to an adjustable footwear system in which the footwear is initially in a tightened state and can be loosened for insertion of a foot and subsequently adjusted after the insertion of the foot.

Description of Related Art

Conventional footwear typically is inherently loose in order for ease of insertion of the foot. The footwear includes a closing mechanism such as a type of lacing, buckle, ratchet or strap in order to close the loose section of the footwear to create a tight fit.

U.S. Pat. No. 8,769,844 describes an article of footwear including an automatic lacing system. The lacing system provides a set of straps that can be automatically opened and closed to switch between a loosened and a tightened position of the upper of the footwear.

It is desirable to provide an adjustable footwear system to loosen the footwear during insertion of the foot into the footwear and provide varying degrees of tightness in different areas of the footwear after the footwear is received on the foot.

SUMMARY OF THE INVENTION

The present invention provides an adjustable article system to provide varying degrees of tightness in different areas of an article. In particular, the article can be footwear. In one embodiment, the present invention is directed to an adjustable footwear system to provide varying degrees of tightness in different areas of the footwear before and after the footwear is received on the foot. The footwear is, in its initial form, tightest on the inner cavity with an upper comprised of one or more elastic materials. The footwear can also include more rigid materials in order to provide additional support or decoration.

The adjustable footwear system includes an extensor system for loosening and tightening the footwear. In particular, the extensor system is activated to create a rigid infra-structure to open a cavity of the footwear between the upper and an insole. The extensor system can be hydraulic and use fluids or air with a device to manually increase the pressure in the extensor system. In one embodiment, the device includes a crank and ratchet device or a pump. Pressure in the extensor system is increased in order to loosen the shoe. Alternatively, pressure in the extensor system is decreased in order to tighten the shoe. The extensor system can include single or multiple chambers within the footwear to allow for varying degrees of tightness in different areas of the footwear. In one embodiment, the extensor system includes one or more extensor arms which are positioned in any direction, or a plurality of directions, in the upper. In one embodiment, the a plurality of extensors are assembled to form a grid or mesh pattern throughout the entire upper.

In one embodiment, when the extensor system has zero pressure, the extensor arms in the upper are pliable, leaving the upper having elastic properties in its original, tightest state on the cavity between the upper and the sole assembly. As the user exerts pressure on the extensor system with the device, the extensor arms become more rigid and extend for expanding the volume of the inner cavity. Maximum and near maximum pressure conditions of the extensor system open the inner cavity sufficiently to allow for easy entry of the user's foot into the cavity. Once the foot is in the cavity, the user can decrease the pressure in the extensor system. The decrease of pressure in the extensor system decreases the cavity volume and allows for the elastic upper to apply pressure to the foot. The pressure in the extensor system is user adjustable to allow the user to determine how much force is exerted by the elastic upper on the foot.

The present invention can be applied to all types of footwear including, but not limited to, athletic shoes, athletic cleats, formal shoes, ski boots, snowboard boots, and standard boots. The present invention can be used as an inner liner for an outer shoe.

In one embodiment, the article can be other wearable items which require a desired fit such as, but not limited to, watch bands, headwear, compression clothing, and durable medical equipment, including medical braces.

The invention will be more fully described by reference to the following drawings.

DETAILED DESCRIPTION

Figure 1:
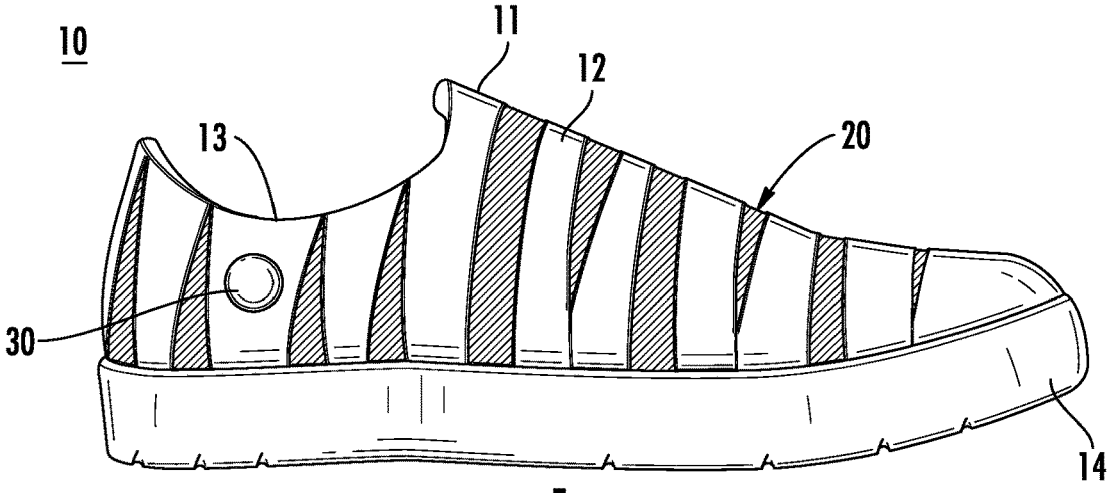
FIG. 1 is a schematic diagram of a side view of the adjustable footwear system in accordance with the teachings of the present invention in an un-activated state.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
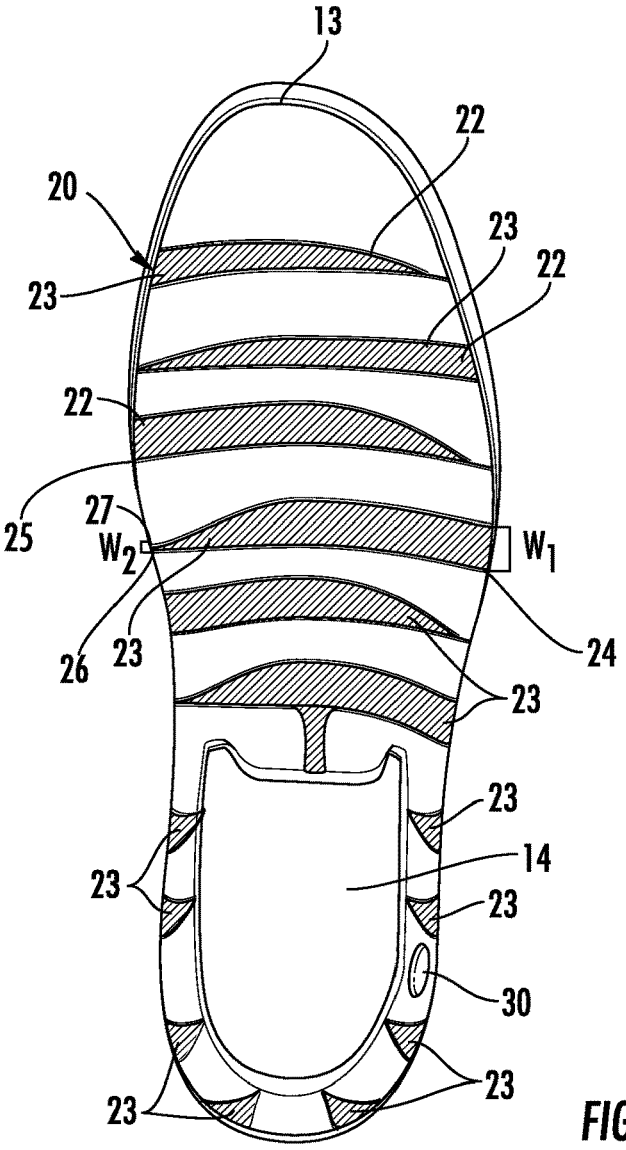
FIG. 2 is a top plan view of the adjustable footwear system shown in FIG. 1.

FIGS. 1 and 2 are schematic diagrams of adjustable footwear system 10 in accordance with the teachings of the present invention. Adjustable footwear system 10 is shown in an un-activated state. Footwear 11 includes upper 12. Preferably, upper 12 is formed of an elastic material. For example, upper 12 can be formed of one or more materials having elastic properties. Suitable materials include, but are not limited to, Lycra, elastic, spandex, neoprene, or PVC. Upper 12 can also include one or more materials which are more rigid. Suitable rigid materials include, but are not limited to, plastic, polyurethane and polypropylene. The rigid material can provide support of upper 12 or decoration. Cavity 13 is formed between upper 12 and insole 14.

Adjustable footwear system 10 includes extensor system 20. Extensor system 20 can be activated by pressure activation device 30 to provide a rigid infra-structure. Extensor system 20 includes a one or more extensors 22. In this embodiment, extensors 22 are formed of extensor arms 23. Extensor arms 23 can be positioned to extend from one side 24 of upper 12 to the other side 25 of upper 12. Width $W_1$ adjacent of respective extensor arms 23 positioned adjacent side 24 or side 25 can be greater than width $W_2$ at end 26 of extensor arms 23. Extensor arms 23 can extend from width $W_2$ to point 27.

Extensors 22 are coupled to pressure activation device 30. Pressure activation device 30 controls pressure within extensors 22. In the un-activated state shown in FIG. 1 and FIG. 2 zero pressure is used in extensor system 20. Extensor arms 23 in the un-activated state are substantially flat within upper 12.

Figure 3:
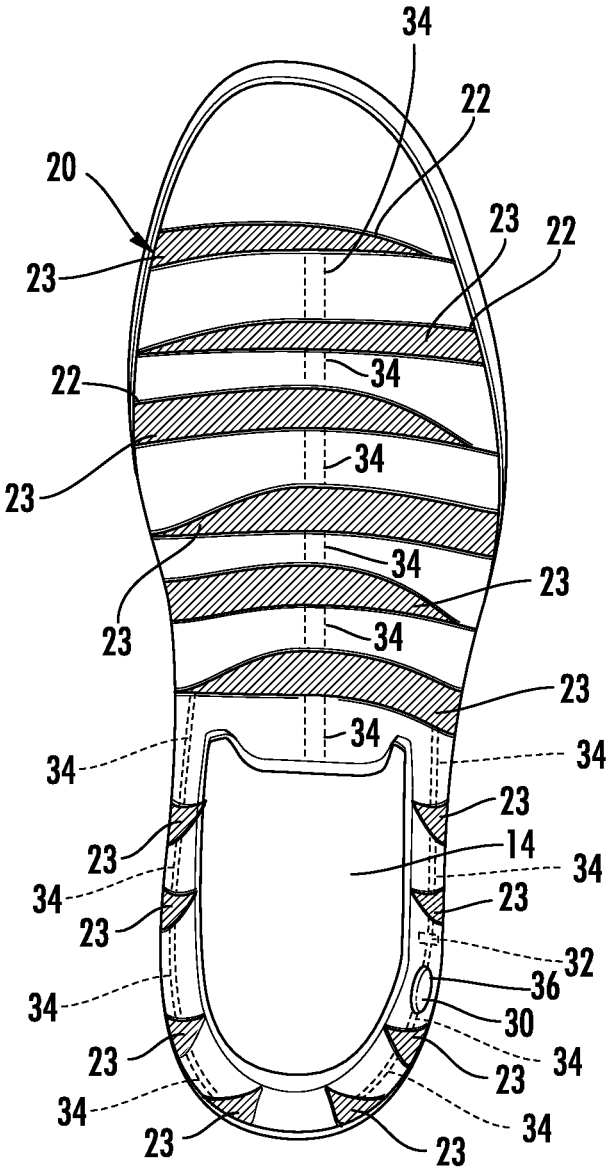
FIG. 3 is a schematic diagram of an extensor system and a pressure activation device which can be used in the adjustable footwear system.

Pressure activation device 30 can be hydraulic and use fluids or air with device 32 to manually increase the pressure in extensor system 20 as shown in FIG. 3. Coupling lines 34 can be used to couple device 32 to pressure button actuator 36. Device 32 can be a pump. Alternatively, device 32 can be a crank and ratchet device or a battery powered device to regulate the desired pressure.

Figure 4:
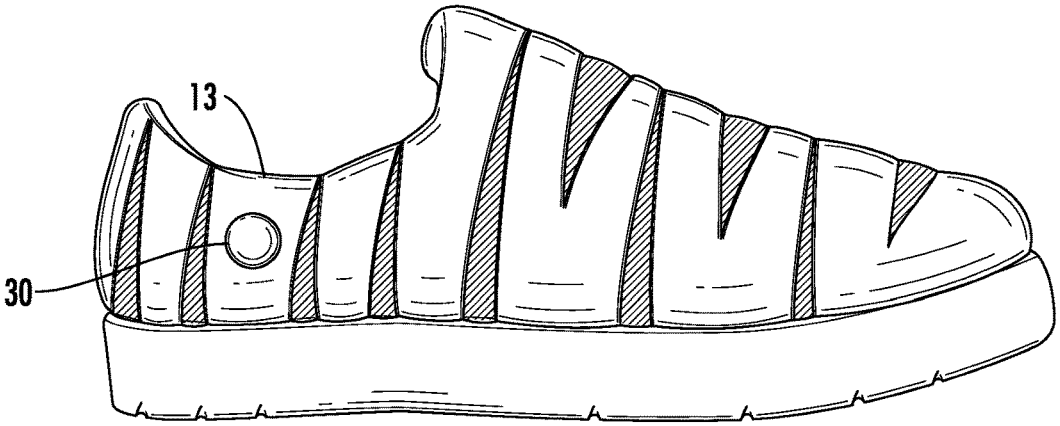
FIG. 4 is a schematic diagram of a side view of the adjustable footwear system in an activated state.
Figure 5:
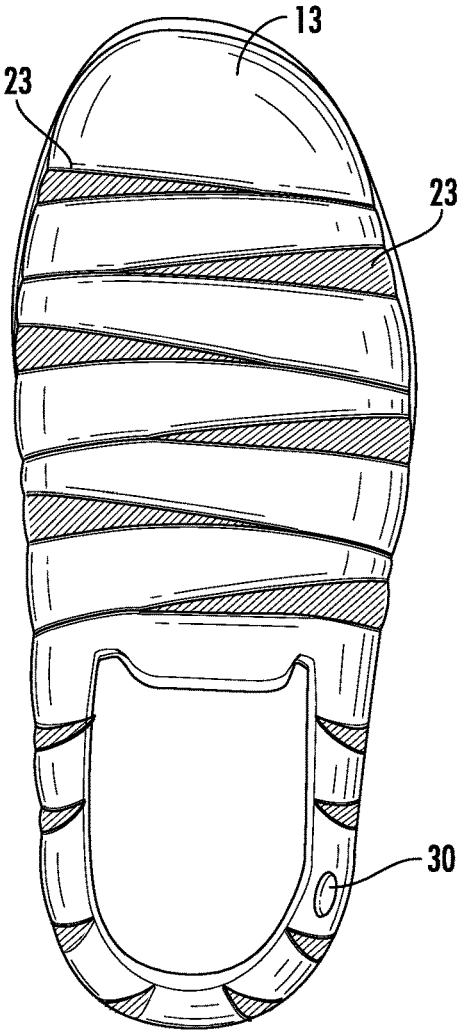
FIG. 5 is a top plan view of the adjustable footwear system shown in FIG. 4.

Activation of pressure button actuator 36 increases pressure in extensor system 20 to increase rigidity of extensor system 20. Referring to FIGS. 4 and 5, in one embodiment, increasing of pressure in extensor system 20 extends extensor arms 23 in a substantially vertical direction to extend upper 12 away from insole 14 thereby increasing the size of cavity 13. In the activated state extensor arms 23 are no longer flat.

Figure 6:
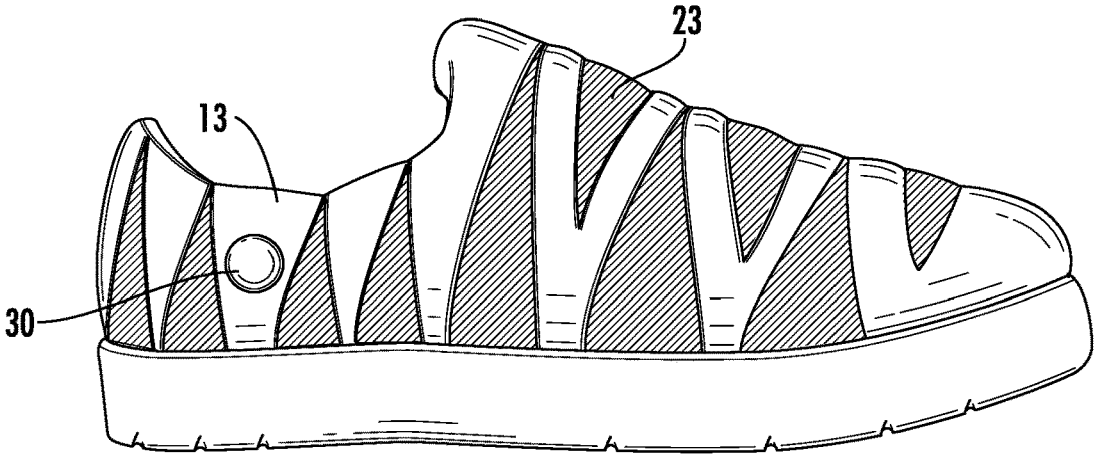
FIG. 6 is a schematic diagram of a side view of an alternative adjustable footwear system in an activated state.
Figure 7:
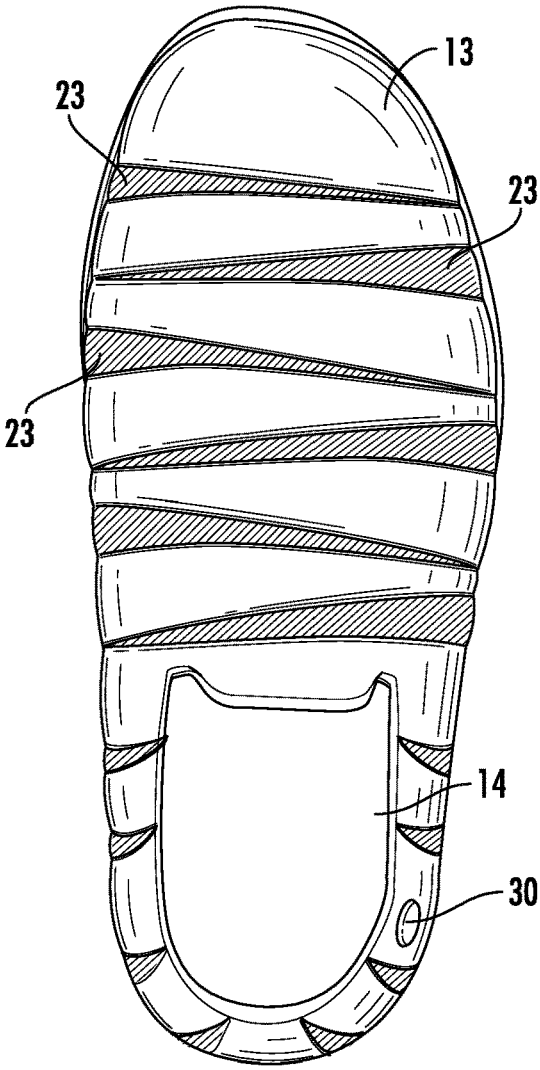
FIG. 7 is a top plan view of the adjustable footwear system shown in FIG. 6.

Referring to FIGS. 6 and 7, in one embodiment, extensor arms 23 expand in both a horizontal and vertical direction to extend upper 12 away from insole 14 thereby increasing the size of cavity 13. In the activated state extensor arms 23 are no longer flat.

Figure 8:
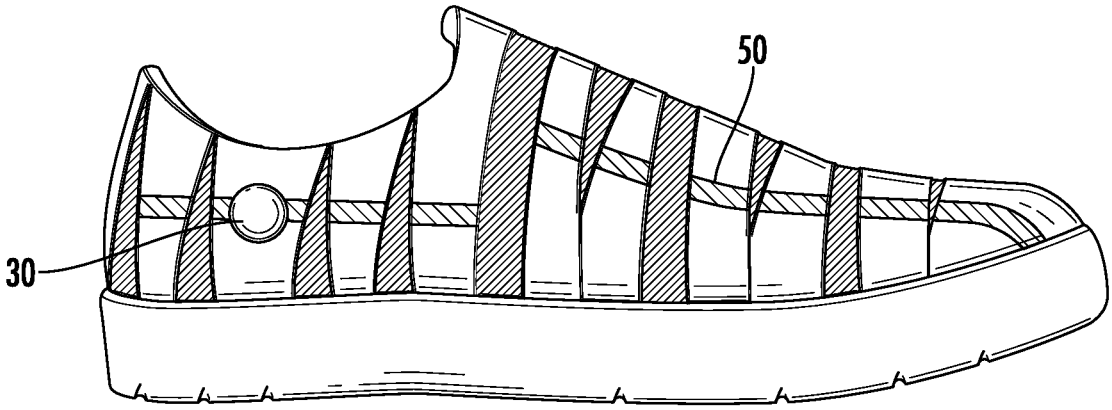
FIG. 8 is a schematic diagram of a side view of an alternative adjustable footwear system in an un-activated state.
Figure 9:
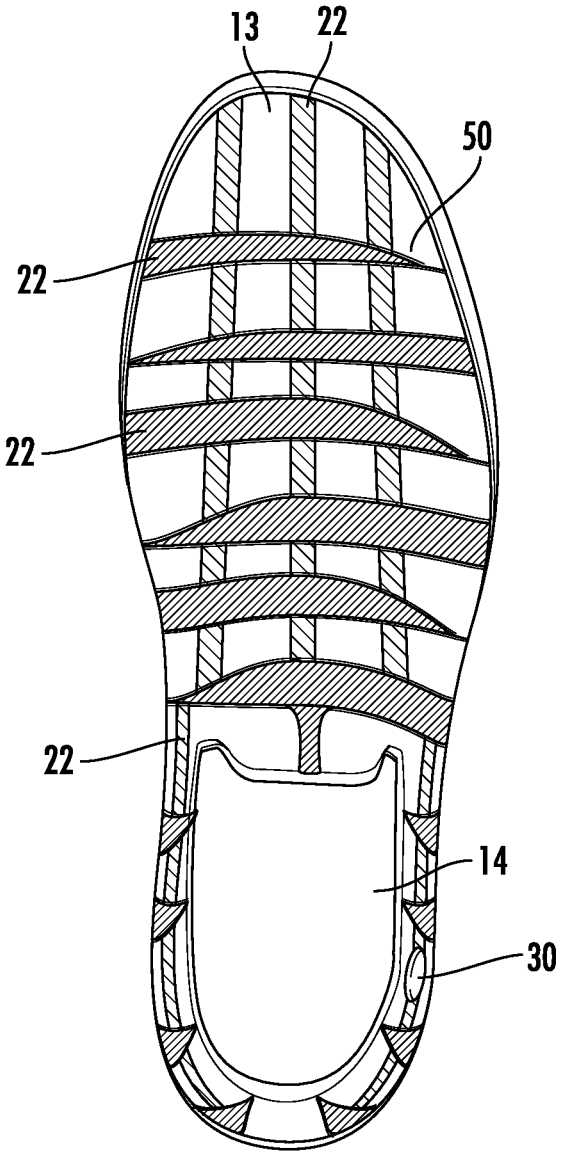
FIG. 9 is a top plan view of the adjustable footwear system shown in FIG. 8.
Figure 10:
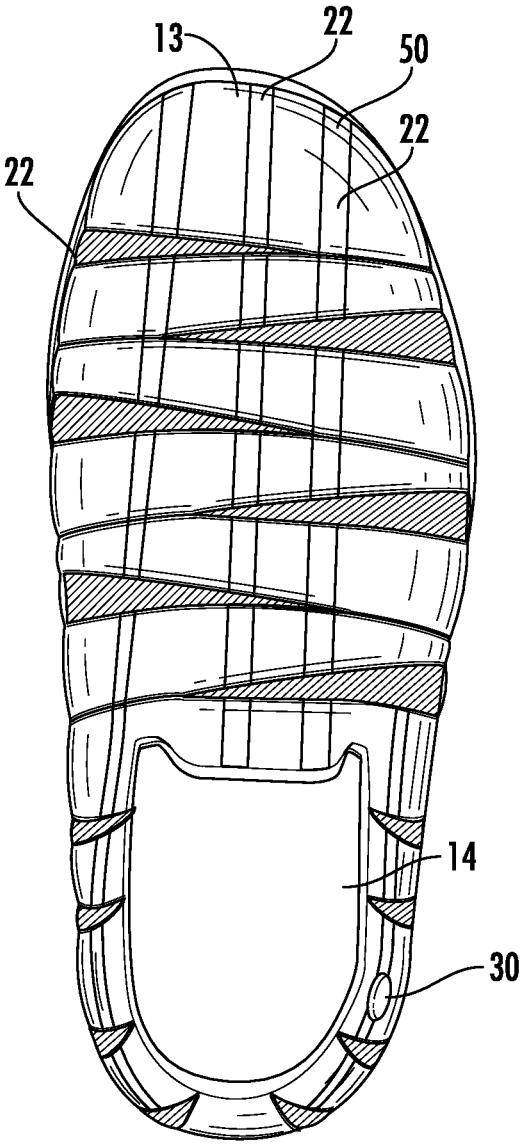
FIG. 10 is a top plan view of the adjustable footwear system shown in FIG. 8 in an activated state.

Referring to FIGS. 8 and 9, in one embodiment, extensor system 20 includes extensor mesh 50 formed of overlapping extensors 22. Pressure activation device 30 can be activated for increasing of pressure to extends mesh 50 away from insole 14 thereby increasing the size of cavity 13 as shown in FIG. 10.

Figure 11:
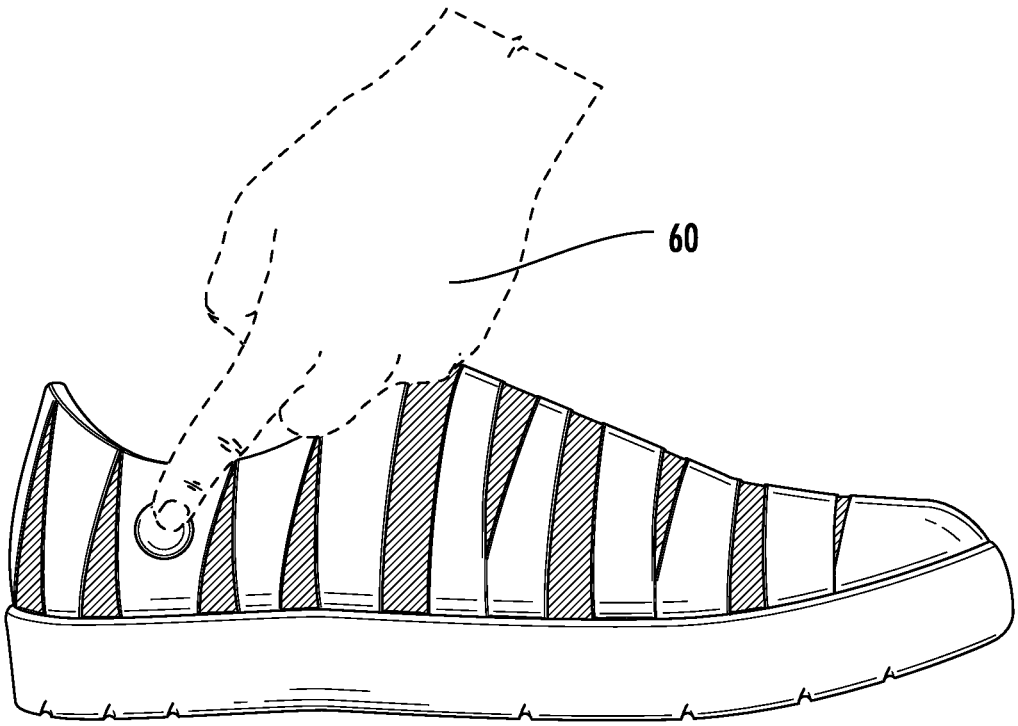
FIG. 11 is a side view of activation of the adjustable footwear system.
Figure 12:
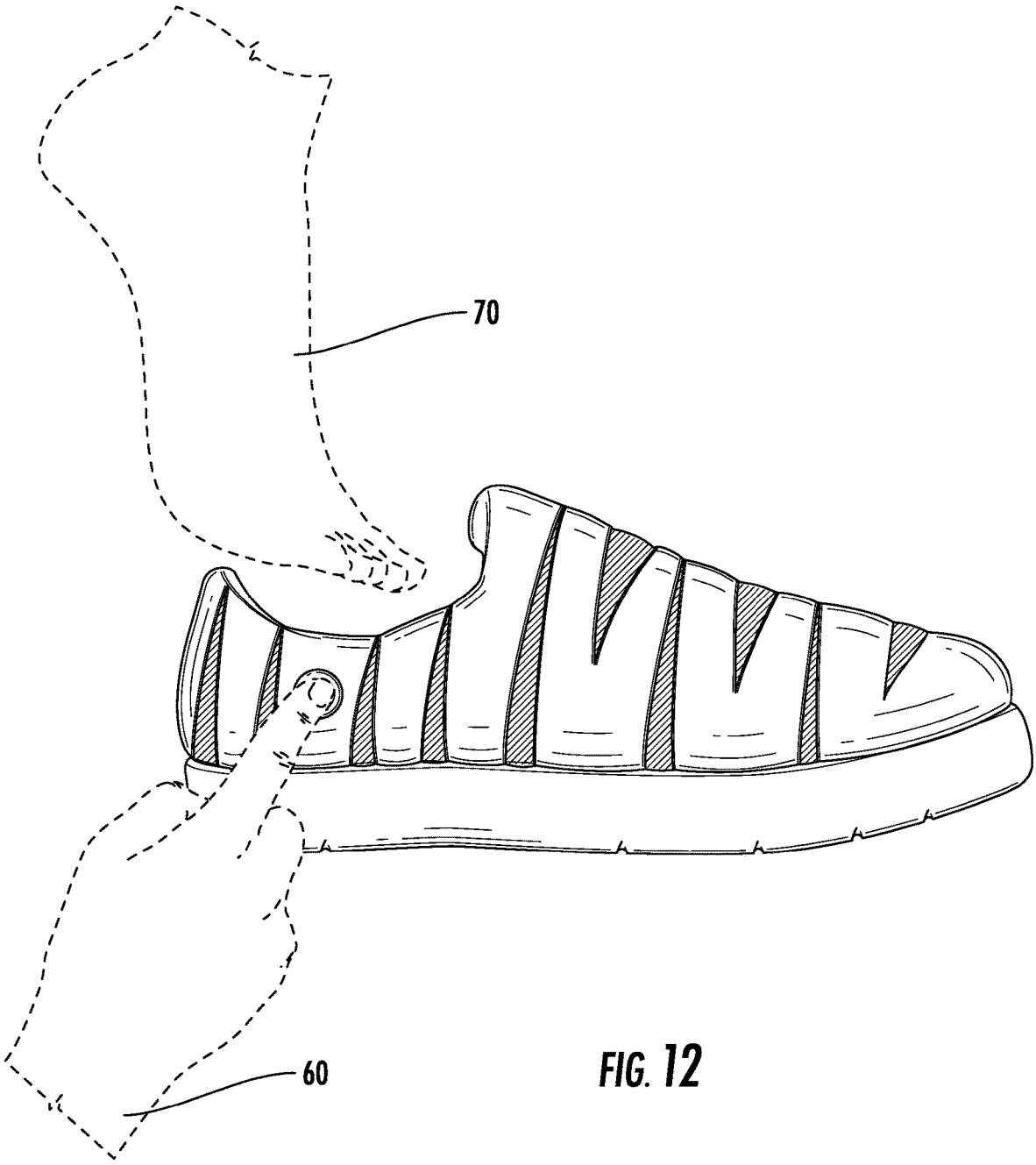
FIG. 12 is a side view of use of the adjustable footwear system after activation.

Activation of pressure button actuator 36 by finger 60 of a user can increase pressure in extensor system 20 to a maximum pressure to expand cavity 13 to its largest volume and allow for easy entry of foot 70 into cavity 13, as shown in FIGS. 11 and 12. Once foot 70 is in cavity 13, finger 60 of the user can activate pressure button actuator 36 to decrease pressure in extension system 20, which decreases volume of cavity 13, and allows for the elastic upper 13 to apply the pressure on foot 70.

Figure 13:
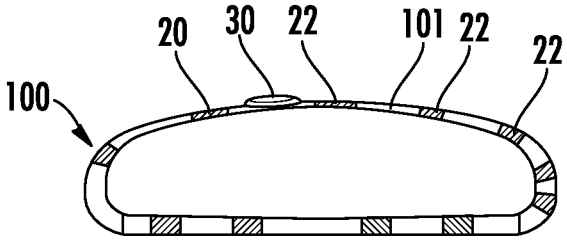
FIG. 13 is a schematic diagram of a side view of the adjustable article system in accordance with the teachings of the present invention in an un-activated state.
Figure 14:
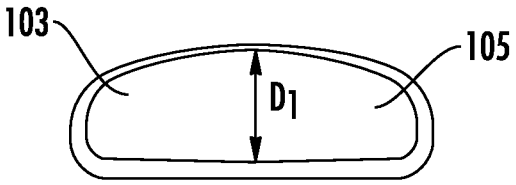
FIG. 14 is a top plan view of the adjustable article system shown in FIG. 11 in an un-activated state.
Figure 15:
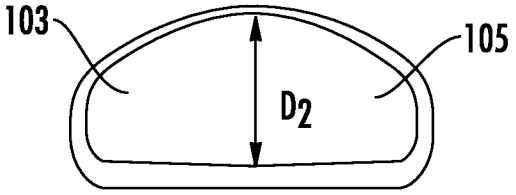
FIG. 15 is a top plan view of the adjustable article system shown in FIG. 11 in an activated state.

FIGS. 13-15 are schematic diagrams of adjustable article system 100 in accordance with the teachings of the present invention. Article 101 can be for example a band or a sleeve such as a watch band, headband or medical band. Adjustable article system 100 is shown in an un-activated state in FIGS. 13 and 14. Article 101 has diameter $D_1$ between sides 103. Article 101 includes embedded extensor system 20 and pressure activation device 30. Extensor system 20 can be activated by pressure activation device 30 to provide a rigid infra-structure. In the activated state shown in FIG. 15, diameter $D_2$ is increased from diameter $D_1$ to enlarge opening 105.

Figure 16:
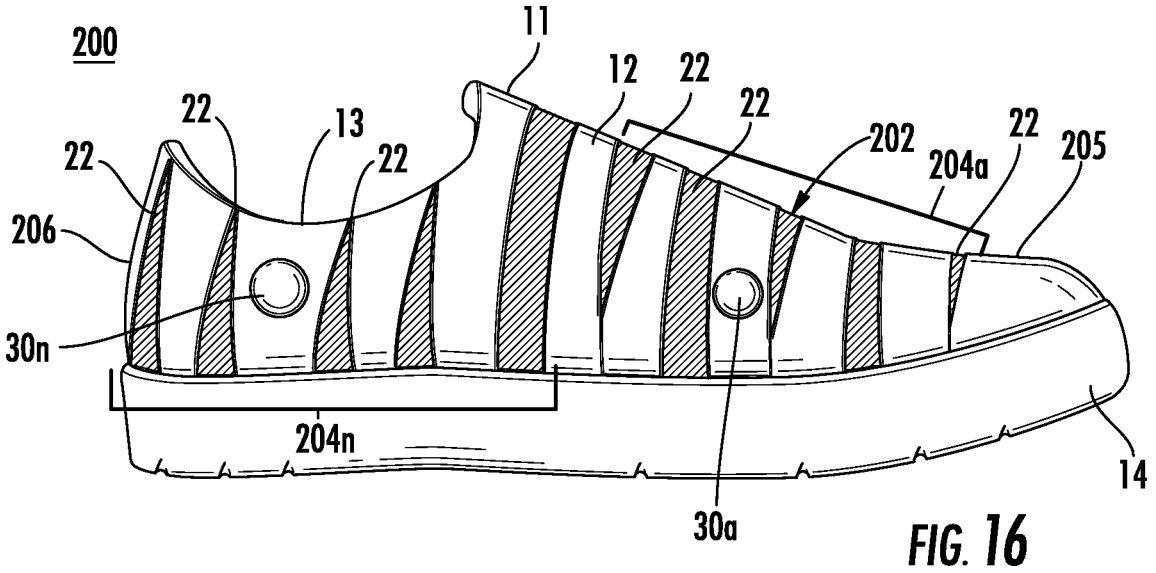
FIG. 16 is a schematic diagram of an extensor system and a plurality of pressure activation devices which can be used in an adjustable footwear system.
Figure 17:
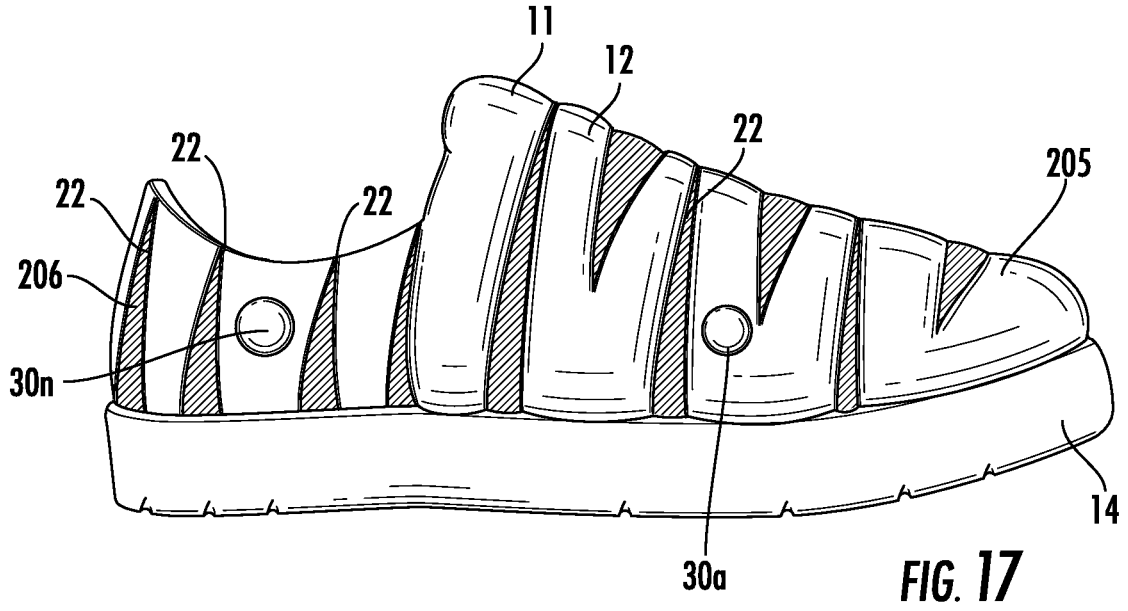
FIG. 17 is a schematic diagram of the extensor system and a plurality of pressure activation devices which can be used in an adjustable footwear system of FIG. 16 in an activated state.

FIG. 16 is a schematic diagram of adjustable footwear system 200 which includes extensor system 202. Extensor system 202 includes first group **204*a* of extensors 22 positioned at front 205 of footwear 11 and second group 204*n* of extensors 22 positioned at rear 206 of footwear 11. Extensors 22 of first group 204*a* can be activated by pressure activation device 30*a* to provide a rigid infra-structure. Extensors 22 of second group 204*n* can be activated by pressure activation device 30*n* to provide a rigid infra-structure. In the embodiment shown in FIG. 17, pressure activation device 30*a* is activated to activate first group 204*a* of extensors 22**. It will be appreciated that any number of groups of extensors can be positioned in footwear and activated by a corresponding number of pressure activation devices to control pressure in different positions of the footwear.

Figure 18:
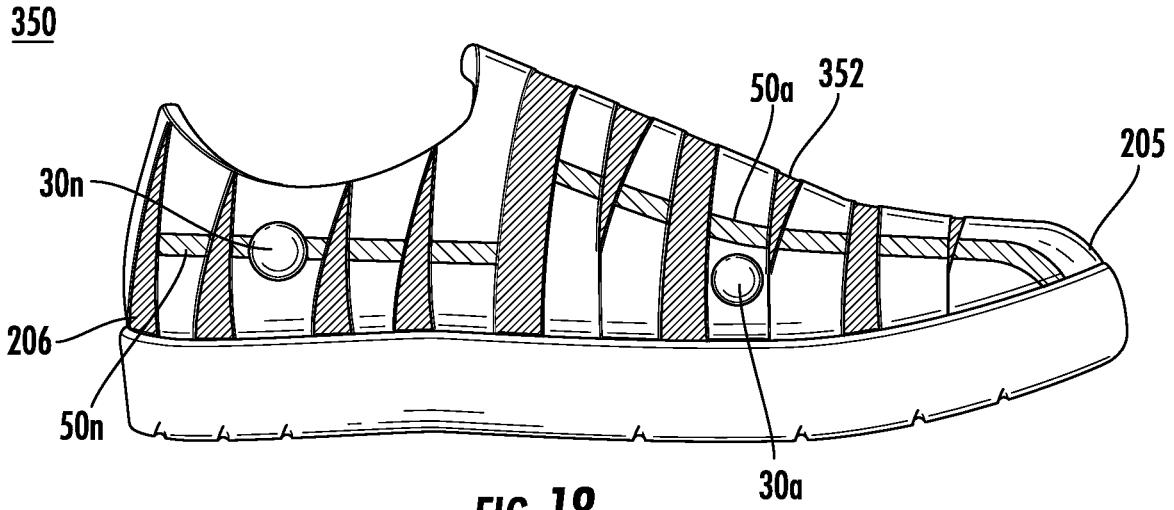
FIG. 18 is a schematic diagram of an extensor system and a plurality of pressure activation devices which can be used in an adjustable article system.
Figure 19:
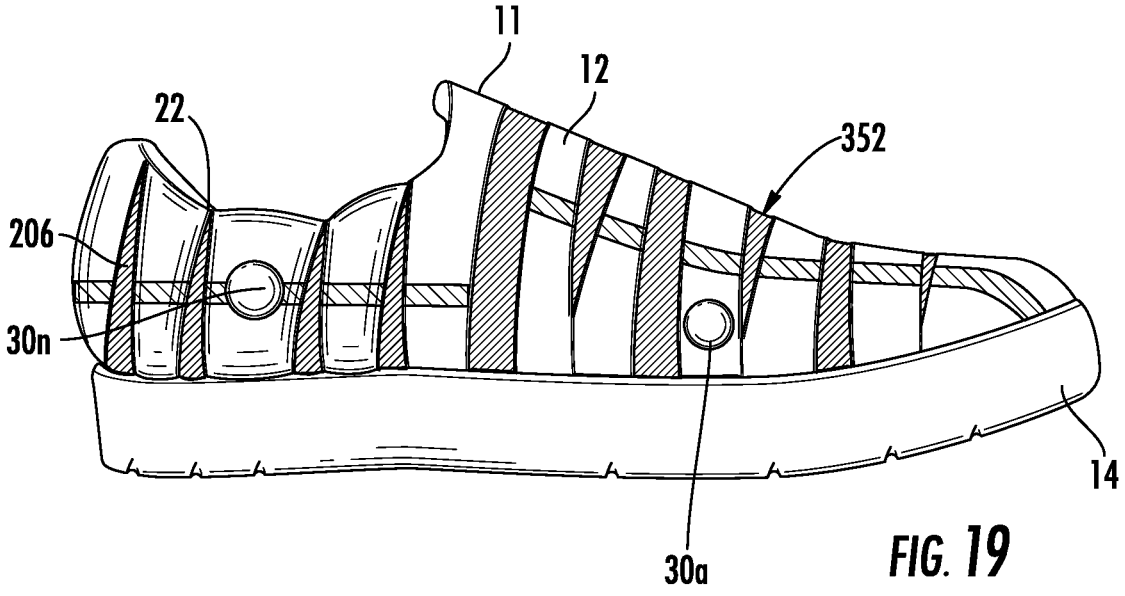
FIG. 19 is a schematic diagram of an extensor system and a plurality of pressure activation devices which can be used in an adjustable article system of FIG. 18 in an activated state.

FIG. 18 is a schematic diagram of adjustable footwear system 350 which includes extensor system 352. Extensor system 352 includes first mesh **50*a* positioned at front 205 of footwear 11 and second mesh 50*n* positioned at rear 206 of footwear 11. First mesh 50*a* can be activated by pressure activation device 30*a* to provide a rigid infra-structure. Second mesh 50*n* can be activated by pressure activation device 30*n* to provide a rigid infra-structure. In the embodiment shown in FIG. 19, pressure activation device 30*b* is activated to activate second mesh 50*n***. It will be appreciated that any number of portions of mesh can be positioned in footwear and activated by a corresponding number of pressure activation devices to control pressure in different positions of the footwear.

Figure 20:
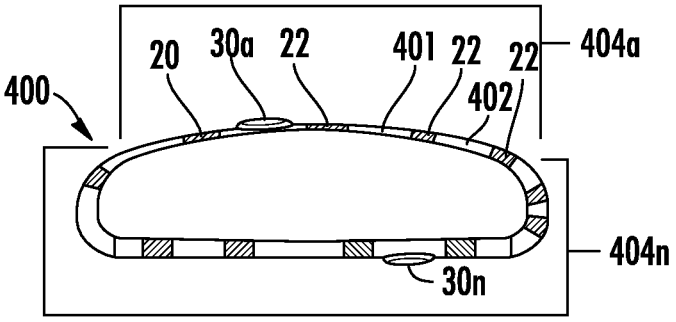
FIG. 20 is a schematic diagram of an extensor system and a plurality of pressure activation devices which can be used in an adjustable article system.

FIG. 20 is a schematic diagram of adjustable article system 400 includes embedded extensor system 402. Extensor system 402 includes first group **404*a* of extensors 22 positioned at side 405 of article 401 and second group 404*n* of extensors 22 positioned at side 406 of article 401. Extensors 22 of first group 404*a* can be activated by pressure activation device 30*a*** to provide a rigid infra-structure.

Extensors 22 of second group 404*n* can be activated by pressure activation device 30*n* to provide a rigid infra-structure.

Figure 21:
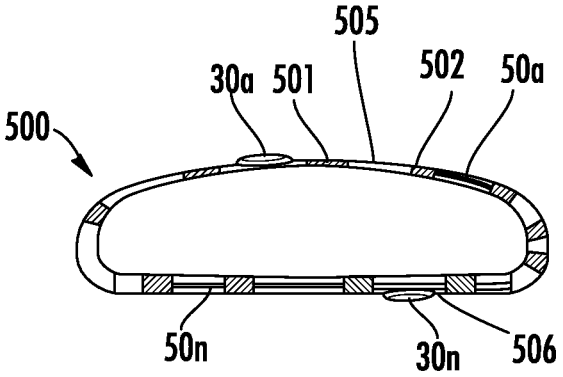
FIG. 21 is a schematic diagram of an extensor system and a plurality of pressure activation devices which can be used in an adjustable article system of FIG. 20 in an activated state.

FIG. 21 is a schematic diagram of adjustable article system 500 which includes extensor system 502. Extensor system 502 includes first mesh 50*a* positioned at side 505 of article 501 and second mesh 50*n* positioned at side 506 of article 501. First mesh 50*a* can be activated by pressure activation device 30*a* to provide a rigid infra-structure. Second mesh 50*n* can be activated by pressure activation device 30*n* to provide a rigid infra-structure. It will be appreciated that any number of groups of extensors can be positioned in the article and activated by a corresponding number of pressure activation devices to control pressure in different positions of the article. Alternatively, mesh 50*a* and mesh 50*n* can be formed in a spiral configuration.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. An adjustable footwear system comprising: footwear including an upper and an insole, a cavity positioned between the upper and the insole, the upper is formed of an elastic material; an extensor system embedded in the upper, the extensor system including a plurality of extensor arms, the plurality of extensor arms overlapping in a horizontal and vertical direction to form a mesh configuration of the extensor arms; and one or more salivation devices for activating the plurality of extensor arms wherein the one or more activation devices are activated for adjusting the extensor system for increasing pressure in the extensor system to expand the plurality of extensor arms in a horizontal and vertical direction in order to extend the elastic material and increase the size of the cavity to allow insertion and removal of a foot in the cavity or the one or more activation devices are activated for adjusting the extensor system for decreasing pressure in the extensor system in order to decrease the size of the cavity, to allow the elastic material to apply pressure against a foot received in the cavity.

2. The adjustable footwear system of claim 1 wherein when the extensor system is activated the extensor system provides a rigid infrastructure.

3. The adjustable footwear system of claim 1 wherein the plurality of extensor arms extend between sides of the upper.

4. The adjustable footwear system of claim 1 wherein the extensor system is pressure activated, said extensor system comprising coupling lines for coupling a device to the plurality of extensor arms, the device being a pump.

5. The adjustable footwear system of claim 1 wherein the activation device is a pressure activation device including a pressure button actuator.

* * * * *